United States Patent [19]

Rauchut et al.

[11] 4,268,823

[45] May 19, 1981

[54] PROTECTIVE ELECTRICAL SYSTEM FOR PROVIDING INDICATIONS OF REMOVAL OF OBJECTS FROM PLURAL MONITORED LOCATIONS BY USE OF PARALLEL-CONNECTED OBJECT-SENSORS

[75] Inventors: Robert F. Rauchut, Ivyland; Louis J. Caparoni, Audubon, both of Pa.

[73] Assignee: ICI Americas Inc., Wilmington, Del.

[21] Appl. No.: 90,847

[22] Filed: Nov. 2, 1979

[51] Int. Cl.[3] ..... G08B 13/18

[52] U.S. Cl. ..... 340/570; 340/555; 340/568; 340/574

[58] Field of Search ..... 340/506, 514, 515, 524, 340/545, 555, 556, 568, 570, 574

[56] References Cited

U.S. PATENT DOCUMENTS

| | | | |
|---|---|---|---|
| 3,638,213 | 1/1972 | Dagle | 340/555 |
| 3,710,372 | 1/1973 | Anderson et al. | 340/555 |
| 4,101,876 | 7/1978 | Lurkis et al. | 340/555 |

FOREIGN PATENT DOCUMENTS 767821 9/1967 Canada .

*Primary Examiner*—Alvin H. Waring

*Attorney, Agent, or Firm*—Albert L. Free

[57] ABSTRACT

A photocell is placed beneath a packet of real or simulated currency at each of a plurality of teller locations in a bank. The photocells at the several teller locations are connected in a parallel circuit with each other, and a voltage supply source is connected to the parallel circuit through a common current-sensing resistance, so that if currency is removed from any teller location this will be indicated by a voltage drop across the common current-sensing resistance. The common current-sensing resistance is located in a control box at a remote location within the bank, and used to control even more remote alarm equipment, at a police station for example. In order to provide a ready indication of the teller location at which currency removal has occurred, each branch circuit at each teller location is provided with its own current-sensing series resistor, and a separate conductor is run from each such series resistor to the control box in the bank, wherein identifiable lamps corresponding to each teller location are provided. A manually-operable test switch, when operated, replaces the remote alarm equipment with a lamp at the control box, so that the system can be tested without sounding an alarm. A simple but effective line-monitoring circuit is also employed.

23 Claims, 4 Drawing Figures

PROTECTIVE ELECTRICAL SYSTEM FOR PROVIDING INDICATIONS OF REMOVAL OF OBJECTS FROM PLURAL MONITORED LOCATIONS BY USE OF PARALLEL-CONNECTED OBJECT-SENSORS

BACKGROUND OF THE INVENTION

This invention relates to apparatus for providing indications of the removal of an object from a monitored location and particularly to such systems in which there are provided not only indications of the removal of an object from a monitored location but also indications of from which of several monitored location the object has been removed.

It is known to protect valuable objects, such as packets of currency in a bank, by providing object-sensing means placed adjacent the object to be protected so as to develop electrical signals indicative of unauthorized removal of the object, which signals may be utilized to operate alarm devices including lamps, bells, cameras trained upon the scene of the unauthorized removal, etc.

One particular application of the invention with respect to which it will be described in detail is at teller locations in banks, or at other currency-handling locations, where currency may on occasion be removed from a cash drawer without authorization, as in the course of a theft or robbery. In such applications it is known to secrete an unobtrusive object-sensing device, such as a photo-sensor of one type or another, adjacent and preferably beneath at least one of the packets of currency at each teller location. By connecting each such object-sensing device across a voltage supply, remote alarm indications may be developed which indicate the unauthorized removal of the currency, without calling attention of the unauthorized remover to the fact that his act has been detected.

One type of photo-sensor arrangement which has been proposed for this purpose is shown in the U.S. Pat. No. 3,300,770 of Brousseau, filed 10/12/64 and issued Jan. 24, 1967. U.S. Pat. No. 4,101,876 of Lurkis, filed Jan. 24, 1977 and issued 7/18/78, shows another photo-sensor type system utilizing more complex electronic circuitry, and employing a reference photo-sensing device to sense the existing ambient illumination, for electrical comparison with the illumination reaching the monitoring photo-sensor device. Neither of these patents is particularly concerned with the situation in which a plurality of objects are monitored at different locations, for example where currency in the cash drawers of a plurality of tellers in a single bank, or at the check-out registers of a store, are to be simultaneously monitored.

In the latter type of situation, we have found it advantageous to be able to provide not only the usual automatic alarm but also to provide a remote indication (preferably at a control position in the same bank or store), as to which monitored location has produced the alarm. While in some cases this may be helpful in identification or apprehension of the person performing the unauthorized removal, we have found it more usually advantageous in connection with false alarms. For example, if an authorized person such as a teller removes the monitored object unthinkingly or accidentally from its monitored location even momentarily, this will ordinarily produce a false alarm with attendant confusion, annoyance, cost and conceivably even injury in answering a false alarm. If the supervising personnel have available an indication of which monitored object, and especially if this indication is automatically caused to persist even though the monitored object is quickly replaced, then supervisory steps can be taken with respect to the person who caused the false alarm to assure that the guilty party will probably not make the same mistake again.

While persistence of the indications of the location of a removal of a monitored object even after replacement of the object is desirable for the reasons mentioned, we have found it advantageous for the alarm itself to terminate as soon as the object is replaced, to avoid irritating and disoncertingly long alarms when only a brief inadvertent object-removal has occurred.

It is also desirable in many cases to provide line-monitoring apparatus which will automatically produce an indication in the event that an open or short occurs in any of the lines interconnecting the several object-monitoring stations or connecting them to the central control box, and to provide such line-monitoring apparatus which is simple yet effective in sensing faults even when there is little difference between the potentials of the monitored lines when faulty as compared to when they are in their normal condition.

It is also generally desirable to provide a simple and reliable built-in test system which, when actuated, will provide an indication that the system is in proper operating condition, without causing the alarm to be sounded.

In practical and commercial versions of such protective systems, it is also desirable for the system to be as simple, reliable and inexpensive as possible, to use as few as possible of long runs of interconnecting cables and wires to permit as simple an installation procedure as possible, and to be at least in part modular, in the sense that identical monitoring stations may be added or removed very easily.

U.S. Pat. No. 3,638,213 of Glenn C. Dagle, issued Jan. 25, 1972 and entitled "Electrical Alarm System" discloses a bank alarm system using one or more photocells for detecting removal of a stack of bills at any of a plurality of teller locations. Each photocell is connected in series with a coil of a corresponding remote relay, and the plurality of photocell-relay coil circuits are connected in parallel with each other and provided with an alternating supply voltage from a common source. Any photocell which is rendered conductive by removal of a stack of bills from above it causes a current through its corresponding remote relay coil, which current causes the corresponding remote relay to operate, which in turn causes another remote relay to operate and produce an alarm indication of removal of the stack of bills. A remote latch circuit is also provided for each parallel circuit, which latch circuit is closed and latched by current through its associated photocell relay coil, and remains latched until a common reset switch is manually operated to break the latch circuit. Each photocell latching circuit is also connected to a corresponding remote lamp, which lamp indicates the teller station at which the stack of bills has been removed. A lamp connected across the supply voltage leads indicates when the power is turned on.

While the Dagle system is no doubt useful in certain applications, it requires a substantial number of rather long leads extending from the individual teller locations to the common control circuits for the bank. It also causes an alarm which continues until manual resetting by supervisory personnel has been accomplished, even if the stack of bills is quickly replaced, as may occur when a teller inadvertently but only momentarily lifts the stack of bills from above its monitoring photocell to produce a false alarm; such long-persisting false alarms are both irritating and upsetting, because it is impossible to distinguish them from true alarms. Furthermore, Dagle does not provide an arrangement for the sensitive detection of breaks in all of the lines interconnecting the photocells, nor any convenient arrangement for testing the entire system without causing an alarm.

Accordingly, it is an object of the present invention to provide a new and useful system and apparatus for detecting and indicating the removal of protected objects from any of a plurality of different monitored locations.

Another object is to provide such system and apparatus which provides appropriate alarm indications of when any protected object has been removed from its monitored location, and in addition provides a separate indication as to which monitored location has been subject to such object-removal.

Another object is to provide such system and apparatus in which replacement of the object into its monitored location terminates the alarm indications but does not terminate the separate indications of the location at which an object-removal has occurred.

It is also an object to provide new and useful line-monitoring apparatus which is simple yet effective, especially in combination with the remainder of the protective system of the invention.

Another object is to provide such a system including built-in test circuitry which, when actuated, will produce indications that the system is in operating condition, without giving an alarm.

A further object is to provide such system and apparatus which is relatively simple and inexpensive, easy to install, maintain, expand or contract in scope, and which requires only a relatively small amount of interconnecting wiring and parts to accomplish its purposes.

SUMMARY OF THE INVENTION

These and other objects and features of the invention are attained by the provision of apparatus for providing first remote indications of the removal of any of a plurality of protected objects from any of a plurality of corresponding monitored locations, and for providing second remote indications of the monitored location at which such removal has occurred, which makes use of a plurality of object-sensing means, preferably photosensor means, one at each of a plurality of monitored locations and each disposed so that the conductance of an element therein changes in response to removal of the associated protected object from its monitored location. In a preferred form, the object-sensing means is a photocell which is normally shadowed by the protected object, but is exposed to ambient illumination to increase its conductance when the object is removed from its monitored location. Paralleling connection means are used to connect the several object-sensing means in respective branch circuits, which in turn are connected in parallel circuit with each other, and a source of supply voltage is connected across the parallel circuit thereby to apply a voltage across each of the object sensing means. Common current-sensing means are connected between the parallel circuit and voltage source, to produce first electrical signals indicative of changes in current flow through the parallel circuit due to changes in conductance in any of the object-sensing means; in the preferred form, removal of a protected object will produce an increase in current through the common current-sensing means, which increase indicates that such object-removal has occurred at some monitored location, while not identifying the location at which the object removal occurred. The system also preferably utilizes a plurality of location-identifying means, comprising a plurality of conductance-sensing means each associated with and positioned adjacent a different one of the object-sensing means, for producing corresponding second signals indicative of changes in the conductance of the corresponding adjacent object-sensing means; in a preferred embodiment, the location-identifying means may comprise a plurality of resistive means each in series with the current path through a different one of the associated object-sensing means, such that a change of voltage occurs across a particular resistive means when the corresponding object-sensing means changes its conductance in response to removal of the protected object. Separate conductor means connect each of the location-identifying means to remote indicator means. The indicator means is responsive to said first signals to produce first indications indicative of said changes in conductance of any of the object-sensing means, and responsive to said second signals to produce second indications indicative of which of said object-sensing means has changed its conductance. In a preferred embodiment the indicator means may comprise two indicator stations remote from each other, at one of which the first indications indicative of the removal of protected object are provided without regard to the location at which unauthorized removal has occurred, and at the other of which said second indications are produced to indicate the monitoring location at which an unauthorized removal has occurred. Preferably means are provided to cause the latter indications to persist until manually reset by an operator, while causing the first, or alarm, indications to terminate if and when the monitored object is replaced.

In the application to protection of banks against theft or robbery, at each teller location there are provided photocell means positioned adjacent the storage location for packets of simulated or real currency bills, so that when a packet of bills is removed the current to the phototcell increases in a detectable manner. Each photocell is connected in its own branch circuit, and all are connected in parallel circuit with each other, this parallel circuit being supplied with voltage from a supply source by way of a common current-sensing means such as a resistance. When the current through any of the photocells increases substantially due to removal of a currencypacket, the resultant change in current through the common current-sensing resistance operates a remote alarm, as at a police station for example. Individual current-sensing means in the form of resistors are connected in each branch circuit so that the voltage across any such resistive element changes when the illumination of the associated photocell is changed due to removal of the currency pack at that location, and conductors extending from each of these branch circuits individually connect them to a remote control panel, preferably within the bank, wherein appropriate latching circuits cause a corresponding lamp to be illuminated and to remain illuminated until reset by an operator, the particular lamp so illuminated comprising an unambiguous indication of which teller location has been subject to removal of a currency packet. Accordingly, if the alarm indication is due to a false alarm, the supervisor will be informed as to which teller caused the false alarm.

Since only a single common current-sensing means is utilized, the expense of the system is thereby reduced. The arrangement for sensing and indicating which location has been subject to unauthorized removal is also simple and inexpensive, and it has been found for example that a single five-wire conductor cable is sufficient for connection to each photo-sensor branch circuit associated with each monitored location, and large numbers of long conductor lines are unnecessary. In addition, within limits, one may add additional monitored locations to this system by very simple connections of a small additional number of wires and photocell circuits.

The line-monitoring circuit which is preferably also used in the system employs a voltage comparator device having operating-voltage supply terminals, a pair of input control terminals, and an output terminal which produces an output current only when said operating voltage are applied to said supply terminals and the voltage at one of said control terminals exceeds that at the other control terminal by a predetermined amount. The photo-sensor branch circuits are connected in series-parallel arrangement by a positive photo-sensor supply line and a negative photo-sensor supply line, one end of the photo-sensor supply lines being connected to remote sources of positive and negative voltages respectively; the other ends of the photo-sensor supply lines are connected through respective voltage-divider circuits to different ones of said control terminals of said comparator. More particularly, the other end of the positive photo-sensor supply line is connected to the remote negative supply through a voltage-divider, the tap of which is connected to one of said control terminals; the other end of the negative photo-sensor supply line is connected to the remote positive supply through a voltage divider the tap of which is connected to the other of said control terminals of said comparator. When the photo-sensor supply lines are intact, this circuit arrangement causes the voltages at said one control terminal to exceed that at the other control terminal and the comparator output is held in one of its states, preferably its High state in which it produces a current through a relay coil or the like connected to it, to produce an indication that there are no breaks or short-circuits in the monitored lines. When a break in one or both of the photo-sensor supply lines occurs, or they become shorted together, the voltage at said one terminal of said comparator no longer exceeds that at said other control terminal, and the current from the comparator ceases, thereby producing an indication of a fault.

Manually-operable test switch means and test indicator means are preferably also provided, which are connected so that, when said switch means is operated, the normal alarm means is rendered inoperable and said test indicator means is substituted for the alarm means to permit system testing by removal of a packet of bills from its monitored location, without causing an alarm.

BRIEF DESCRIPTION OF FIGURES

These and other objects and features will be more readily understood from a consideration of the following detailed description, taken in connection with the accompanying drawings, in which.

DETAILED DESCRIPTION OF SPECIFIC EMBODIMENTS

Figure 1:
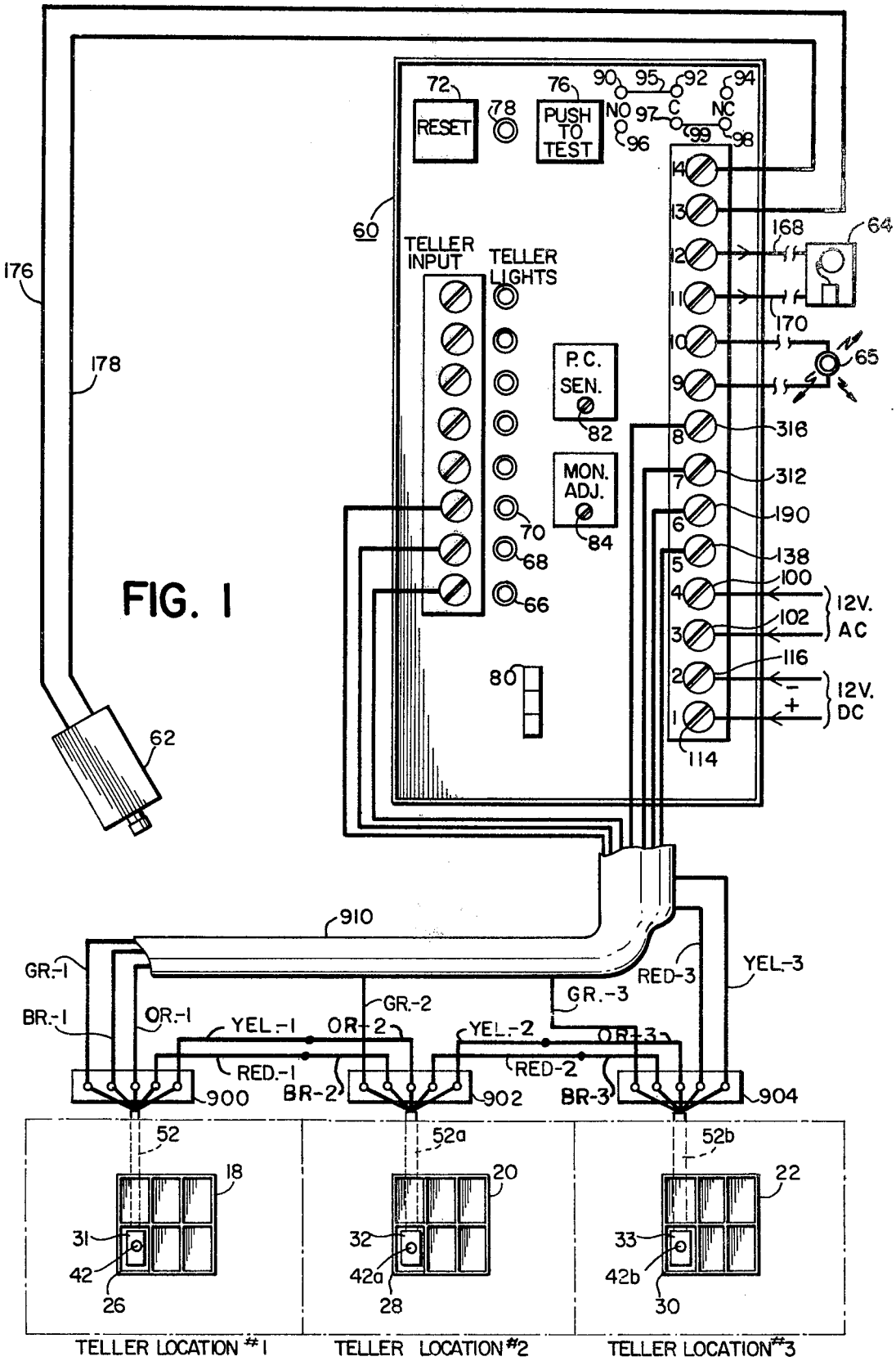
FIG. 1 is a schematic plan view of a banking floor showing a plurality of teller locations and a typical layout of the protective system of the invention, with the alarm control box greatly exaggerated in size in the interest of clarity, and also showing alarm and indicator apparatus at a more remote central station.

Referring now to the specific embodiment of the invention shown in the drawings by way of example only, FIG. 1 illustrates schematically how the invention may be applied for alarm purposes in a bank. Shown therein are three teller locations #1, #2 and #3 at which are located corresponding respective cash drawers 18, 20, 22; while the system shown can readily accommodate up to eight such teller locations, only three are shown to simplify the drawings. Each drawer has a plurality of compartments for receiving packets of currency, and in this example each drawer is provided with a special monitored compartment, as at 26, 28 and 30 respectively; each of the latter compartments therefore comprises a monitored location in which is normally located the protected object, in the form of a packet of bills of currency. While in some cases the packet in the monitored location may be a bogus packet, such as that described in U.S. Pat. No. 3,828,341 of Carter, Jr. et al., issued Aug. 6, 1974, and containing electronic circuitry, an explosive device, and a source of red stain and tear gas for the purposes described in that patent, in the interest of simplicity of exposition it will be assumed in this example that packets of genuine bills of currency are placed in the monitored compartments.

Figure 2:
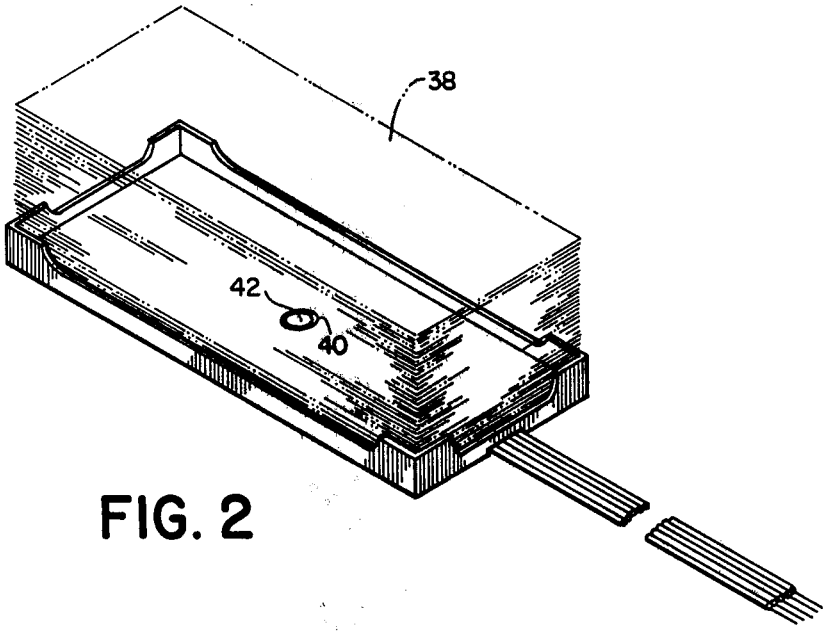
FIGS. 2 and 3 are a perspective view and bottom view, respectively, of a typical object-detecting base plate, with bottom cover removed, on which a protected packet of bills is normally located.
Figure 3:
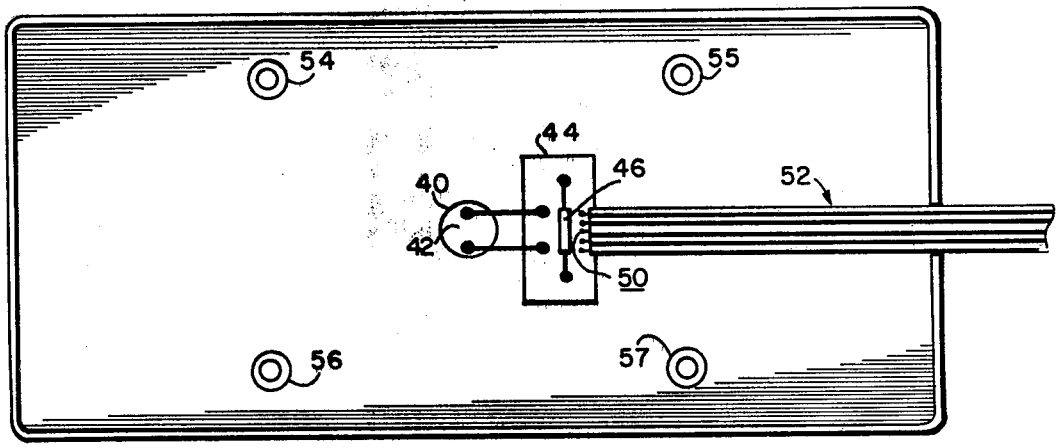

In each of the monitored compartments 26, 28 and 30 there is located a special base plate 31, 32, 33, respectively, on which the packet normally rests; one such base plate is shown particularly clearly in FIGS. 2 and 3 hereof, the others being identical to it. The base plate 31 is appropriately sized, and provided with fragmentary rims near its corners, so as to receive the packet of bills 38, and is provided with an opening 40 extending vertically through it into which a photocell 42 is fitted so as to be illuminated by light from above when exposed thereto by removal of the packet. The photocell in this example is of the type which decreases its resistance when more strongly illuminated. The underside of the plate is recessed to receive a small printed-circuit board 44, to which the two leads from the photocell are connected, and on which a resistive element 46 is mounted. Five terminals designed generally as 50 are also provided on the printed circuit board, from which five corresponding separate leads extend in the form of a flat flexible cable 52. The printed circuit is provided with appropriate connections for completing the electrical circuit in accordance with the diagram of FIG. 4 hereof. When the base plate is to be used with a bogus packet, three magnets may be mounted in the recessed underside of the base plate to provide the functions described in the above-identified U.S. Pat. No. 3,828,341. A bottom cover plate (not shown) may be secured to the underside of the base plate by means of screws extending into the bosses 54, 55, 56 and 57. At teller locations #2 and #3, the photocells are shown at 42*a*, 42*b*, and the five-wire cables at 52*a*, 52*b*, respectively.

Considering first the overall functional aspects of the system as an aid in understanding the more detailed description presented hereinafter, referring to FIG. 1 the typical system shown comprises, in addition to the special base plate with photocell and flexible cable at each of the teller locations, an alarm control box 60, a camera 62, an arrangement of conductors or leads extending from the base plates to each other and to the alarm control box, other leads connecting the camera 62 to the control box, and further leads for connecting to AC or DC supply sources and for connection to a remote alarm device 64 and a remote line-monitoring lamp 65, at a central station.

The alarm control box 60 contains, behind the front panel shown in FIG. 1, electronic circuitry and indicator and control elements to be described hereinafter, and is usually located in a portion of the bank remote from the teller locations, as in a manager's office, a security personnel office or a utility closet, an examples. It will be understood that the alarm control box need not be of box-like shape, but may be in the nature of a control panel, a desk-top unit or any other convenient configuration.

The general operation is as follows: after each of the special base plates at the teller locations is covered with a currency packet so as to block light to the photo-cell associated with it, the system is turned on. So long as the currency packets remain in position on the special base plates and the system is intact and operating properly, no alarm signal will be delivered to the remote alarm device 64, which may be located at the offices of a security company or in a police station as examples, and hence no alarm will be given. Each of the eight teller lights such as 66,68 and 70 in the alarm control box will remain extinguished, and the camera 62 will not operate. However, should one of the packets of bills be removed from its special base plate at one of the monitored locations, the resultant exposure of the underlying photocell to the ambient illumination will produce an electrical signal which is transferred to the alarm control box over the interconnecting lead system shown in the drawings. The electrical circuitry within the alarm control box behind the front panel shown at 60 is represented in detail in FIG. 4 hereof, and responds to the signal generated by removal of the bill packet from the monitored location to change the current through the remote alarm device 44 and thus sound the remote alarm. It also causes the camera 62 to begin operation, so as to photograph the scene at the teller's locations.

At the same time, one of the teller lights in the alarm control box becomes illuminated, namely that particular one of the teller lights which corresponds with the teller location at which the currency packet has been removed. In the present example, removal of the packet at teller location #1 will cause the teller light 66 to be illuminated; removal of packets at teller locations #2 or #3 will cause teller lights 68 to 70 to be illuminated. If the removed bill packet is then replaced in its proper position, the current level in the remote alarm device 64 which caused the remote alarm will terminate, but the teller light 66 will remain illuminated. Accordingly, even should the person who removed the bill packet replace it immediately, supervising personnel will be able to determine, by observing the continued illumination of teller light 66, that it was the teller at location #1 who produced the alarm (if indeed it was the teller who produced it, as opposed to a robber or thief). A supervisor can then impress upon that teller the need for much greater care in avoiding inadvertent or unthinking removal of the currency packet from the monitored location, since this causes troublesome false alarms.

To reset the system to its original condition after the removed currency packet is replaced in its monitored location, the reset button 72 on control box 60 is pressed by supervisory personnel to return the system to its original non-alarm condition, and all teller lights are thereby extinguished. The camera 62 is also automatically turned off when the packet is replaced in its monitored location. If the removal of the packet is by, or at the instance of, a robber or thief for example, the above-outlined operation will occur as described, with the automatic remote alarm occuring and the corresponding teller light or lights becoming illuminated whenever one or more of the packets at any of the monitored locations is removed.

Alarm control box 60 also includes a push-to-test button 76, which supervisory personnel may push at any time to determine that the alarm control box circuitry and the photocell circuitry are functioning properly, as will be indicated by illumination of the test lamp 78 while the push-to-test button is being operated and while a packet of bills is removed from its associated base plate.

The front panel of the alarm control box 60 also holds a conventional system fuse 80, a photocell sensitivity control 82 and a line-monitor adjustment control 84 which are adjusted for best operation in initially setting up the system, and are constructed and arranged in the circuit as will be described fully herein with particular reference to FIG. 4.

Also presented on the front panel of the control box 70 are a camera jumper arrangement comprising three small plugs 90, 92 and 94 respectively labeled NO for normally open, C for common, and NC for normally closed. A U-shaped conductive jumper 95 can be placed so as to extend between plug 90 and 92, or between plug 92 and 94 depending upon whether normally open or normally closed operation is desired, as will be described hereinafter, and as shown the jumper is in the normally-open position. Similarly with respect to the alarm connections leading to the remote relay coil 64, three plugs 96, 97 and 98 are provided so that the common plug marked C can be connected either to the "normally-closed" plug 98 or to the "normally-open" plug 96 by the jumper 99, and in this example the jumper 99 is shown in the normally-closed position.

The details of arrangement and operation of the electrical circuitry of the invention will now be described with particular reference to FIG. 4, after which the details of the particular arrangement of interconnecting wires and cables in FIG. 1 will be discussed.

Starting this description with the operating power supply, terminals 100 and 102 are supplied with 12 volts AC, which is applied through a conventional fuse 80 to the bridge rectifier 104. The output of the bridge rectifier is filtered by a parallel capacitor 106 and passed through a commercial voltage regulator 108, whereby a system DC operating voltage of about 12 volts is developed between positive supply line 110 and negative supply line 112, these supply voltages being designated for convenience as B+ and B−, respectively. Terminals 114 and 116 are also provided, connected respectively to the positive bridge output and to the B− line 112, whereby an externally-developed 12 volt DC voltage can also be coupled into the system. Typically this voltage may be supplied by a rechargeable battery, which is permanently connected to terminals 114 and 116 and continuously maintained charged by the operation of the AC-powered supply described above; however, should the alternating supply voltge disappear due to a power failure or the like, the 12 volt DC source will continue to maintain the system in proper operation.

Power supply lines 110 and 112 are extended to 110*a* and 112*b* to provide B+ and B− for the alarm circuit now to be described. A first NPN transistor 120 is connected in the common-emitter circuit configuration by connection of its collector to B+ line 110*a* by way of collector resistor 113 and by connection of its emitter to B− line 112*b* by way of emitter resistor 124. This transistor is maintained in a highly conducting condition during non-alarm times by connection of its base to B+ line 110*a*, by way of the series combination of diode 130, resistor 132 and variable resistor 82. Diode 130 is poled so that its cathode terminal is connected to the base of transistor 120 and serves, due to the internal voltage drop across it when in its forward-biased condition, to provide a substantial voltage at the interconnection terminal 138 between diode 130 and resistor 132.

A second transistor 140 is also connected in the common-emitter configuration, with its emitter connected directly to the emitter of transistor 120 and its base directly connected to the collector of transistor 120, from which a resistor 141 extends to the negative supply line.

The collector of transistor 140 is normally connected to the positive supply line 110*a* by way of the parallel combination of relay coil 144 and damping diode 146. Diode 146 serves the conventional purpose of damping inductive transients. Also connected in series in the collector circuit of transistor 140 is the movable arm 150 of the push-to-test switch 76, which arm is normally in the position shown as to complete the collector circuit through the relay coil 144, but is manually actuable to its opposite position in which the collector of transistor 140 is disconnected from relay coil 144 and instead is connected to the positive supply line 110*a* by way of the series combination of resistor 152 and light-emitting diode 154, which is the light source for lamp 78 of FIG. 1.

In the non-alarm condition in which the packets of currency are covering the photocells at the monitored locations, the highly-conducting condition of transistor 120 causes its collector to be at a relatively low positive voltage and its emitter to be a substantial positive voltage, both sufficient that, when applied directly to the base and emitter respectively of transistor 140, they maintain the latter transistor in a current cut-off condition so that no current flows through the relay coil 144. The relay contacts 160 for controlling the remote alarm device 64 and the contacts 162 for controlling the camera 62 are operated by coil 144, and it is assumed that the jumpers 95 and 99 are in the positions shown therein. Leads 168 and 170 from the alarm relay contacts are connected together by the relay contacts, as shown, when coil 144 is not conducting, and current passing between these leads from a remote station such as the police station will indicate a non-alarm condition. Such current may be used, for example, to operate a remote relay which holds alarm devices out of their actuated condition during such non-alarm times. Similarly, with no current through relay coil 144, camera leads 176 and 178, which extend to camera 62 of FIG. 1, will be open-circuited from each other, thus preventing operation of the camera during such non-alarm times.

However, should the illumination and hence conductance of one of the photocells increase due to removal of a currency packet, the resultant increase in photocell current will cause the voltage at terminal 138 to become substantially more negative, transistor 120 will become cut off, and transistor 140 will conduct heavily. The resulting current through relay coil 144 will reverse the switch positions shown for the alarm and camera relay contacts; this causes the leads 168 and 170 from the alarm contacts to become open-circuited, thus producing a remote alarm, and causes the leads 176 and 178 from the camera contacts to become closed, thus starting the camera. As soon as the currency packets are all returned to their monitored positions so that all photocell are covered, transistors 120 and 140 will return to their non-alarm states, as will the alarm and camera relay contacts, stopping the camera and terminating the remote alarm.

To test the circuit, at least one of the packets of bills is removed from its base plate so as to expose the corresponding photocell to ambient illumination, but only after the push-to-test button 76 has been manually actuated so as to remove alarm relay coil 144 from its operating position in the collector circuit of transistor 140, thus preventing a false alarm. Assuming that the circuitry is intact and operating properly, with the push-to-test button actuated to its test position, and with at least one currency packet removed from its monitored location, current will pass through transistor 140 and the light-emitting diode 154, providing a visual indication at lamp 78 on the control box panel that the system is operating properly. The currency packets are then replaced on all the base plates, after which the push-to-test button is released, to place the alarm circuit in its normal monitoring condition.

Considering now in detail the photocell monitoring circuitry, terminal 138 of the alarm circuit is connected to one terminal of resistive element 46 and thence through photocell 42 to negative supply terminal 190. In order to make more clear the actual wiring arrangement, the various leads which connect the photocells in series-parallel arrangement with each other and to the alarm control box are individually identified in the drawings as they may be in an actual color-coded wiring arrangement. Thus BR designates a brown-covered lead, RED designates a red-covered lead, OR designates an orange-covered lead, YEL designates a yellow-covered lead, and GR indicates a green lead. The suffix numbers after each color designation identify different leads having the same color of covering, the large block dots such as 191 representing, in this example, wire connection points.

It will be seen that the photocell circuits on each of circuit boards 44, 44*a* and 44*b* are identical. The positive photocell supply line from terminal 138 is connected first to the top of resistor 46, then to the top of resistor 46*a*, then to the top of resistor 46*b*, whence an output line 310 extends to a line-monitoring input terminal 312. Similarly, the negative photocell supply line from terminal 190 extends first to the lower end of photocell 42, then to the lower end of photocell 42*a*, next to the lower end of photocell 42*b*, and thence over lead 314 to the line-monitoring input terminal 316. Photocell-identifying leads GR-1, GR-2 and GR-3 extend from the upper ends of photocells 42, 42*a* and 42*b*, and are connected respectively to input terminals 300, 302 and 304 at the right edge of FIG. 4, for reasons described hereinafter.

It will be appreciated, then, that the photocells 42, 42*a* and 42*b* are connected in series-parallel connection with each other, and that this parallel combination is connected in series with the resistance made up of the fixed resistor 132 and the variable resistor 82, between the system positive supply line 110*a* and the system negative supply line 112*b*. When all of the photocells are darkened by the presence thereon of the packets of currency, all of the branch circuits in which they are connected exhibit a very high resistance, and will have no appreciable effect upon the non-alarm operation of the alarm circuit comprising transistors 120 and 140, and the latter circuit will therefore produce no remote alarm and the camera will not operate at such times. However, should any one or more of the photocells be illuminated by the removal of one or more corresponding packets of bills, the conductance of any such illuminated photocell will rise substantially, causing substantial current to flow through it by way of terminals 138 and 190. This causes the voltage at terminal 138 to drop, and thereby causes the alarm circuit to enter its alarm condition, as fully described above, wherein the remote alarm becomes operated and the camera begins to run. Replacement of all of the packets on the respective photocells will terminate such operation, returning the alarm circuit to its original non-alarm condition.

Adjustment of the variable resistor 82, constituting the manual photocell sensitivity control at control box 60, will change the level of current through any photocell required to cause the alarm circuit to change to its alarm state, and this sensitivity control is preferably adjusted to provide greatest sensitivity of the alarm circuit consistent with a sufficient margin of error such that the alarm circuit will not be operated to a flase alarm condition due to interference, electrical noise, stray light reaching the photocell, or the like.

It is further noted that when none of the photocells is conducting, there will be substantially no voltage drop across its corresponding series resistor 46, 46*a* or 46*b*, hence the voltage on its corresponding photocell-identifying line such as GR-1, GR-2, GR-3 will remain substantially at the voltage of terminal 138. However, when any or all photocells become conductive due to removal of the packets of currency from above then, the corresponding photocell-identifying lines GR-1, GR-2 and/or GR-3 will experience a drop in voltage due to the current through the corresponding resistor 46, 46*a* and/or 46*b*. The manner in which the latter changes in voltages on the photocell-identifying lines are used to actuate the teller lights 66, 68 and 70 will now be described.

Each of the input terminals 300, 302 and 304, connected respectively with the photocell-identifying lines GR-1, GR-2 and GR-3, is connected to an identical teller-light operating circuit, hence only that associated with line GR-1 will be described in detail. Input terminal 300 is connected through series resistor 400 to the negative input terminal of an operational amplifier comparator device 402, the other, positive input terminal of which is supplied with a reference voltage from the tap point 404 on a voltage divider consisting of resistors 406 and 408 connected in series between the positive supply line and the negative supply line. Device 402 is supplied with positive operating potential over lead 410 and with negative supply voltage over lead 411; it is adjusted and selected so that if photocell 42 is not illuminated, and hence not conductive, the voltage level at the negative input terminal of device 402 is sufficiently close to the reference level at the positive input terminal thereof that no output current will then be produced on output lead 412 of device 402. A bypass filter capacitor 413 is connected in parallel with input resistor 400 to eliminate spurious interference signals at the input of device 402.

The output lead of device 402 is connected through series resistors 450 and 460 to the negative supply line, and hence when device 402 is not producing output current, the voltage at the tap point 462 between resistors 450 and 460 will be relatively negative, i.e. substantially the same as the negative supply voltage. However, should the conductance of photocell 42 be reduced due to its illumination upon removal of a packet of currency therefrom, the voltage at input terminal 300 will drop substantially, i.e. will become less positive, and device 402 will produce sufficient output current that the voltage at tap point 462 rises substantially, for the purpose and with the effect now to be described.

A light-emitting diode 66 is connected in series with a resistor 500 and with a silicon controlled rectifier 502, this series combination being connected between positive supply line 410 and the negative supply line for the system. Silicon controlled rectifier 502 exhibits the usual characteristics of such devices in that it remains non-conductive until the voltage on its gate electrode 510 rises beyond a threshold value to trigger it into conduction; after this, it will continue to remain in its conductive condition even though the voltage on its gate electrode again falls below the threshold level, and it will return to its non-conductive state only when the positive supply voltage on its anode is reduced sufficiently. Thus in the present example, when photocell 42 is non-conductive and the voltage at terminal 300 is relatively high, the voltage at divider tap point 462 is low and silicon controlled rectifier 502 remains non-conductive. However, when photocell 42 is rendered conductive by the removal of the currency packet therefrom, the voltage at tap poing 462 becomes sufficient to trigger the silicon controlled rectifier 502 into conduction. This causes current flow through the light-emitting diode 66, which thereupon emits light indicative of the removal of the bill packet from above photocell 42. Silicon controlled rectifier 502 remains conductive, and light-emitting diode 66 continues to emit light, until the normally-closed pushbutton reset switch 72 is manually operated to remove positive supply voltage from line 410, and hence from the anode of silicon controlled rectifier 502, causing it to become non-conductive and extinguishing the light-emitting diode 66; light-emitting diode 66 will of course remain extinguished, after the reset button is released to restore positive potential to the anode of the diode.

The same operation occurs in response to increase of voltage on either of the other photocell-identifying leads GR-2 and GR-3 due to removal of a bill packet at either of stations #2 or #3, resulting in illumination of the corresponding light-emitting diode 68 or 70 only when the corresponding photocell has been exposed to ambient illumination. In each case, even if a previously-removed packet of bills is immediately replaced upon its base plate, the corresponding light-emitting diode will continue to produce illumination until supervisory personnel operate the reset button, thus providing an opportunity for supervisory personnel to detect and observe which teller location has been subject to removal of a currency packet, and to exert appropriate supervisory action with respect to the personnel responsible.

The positive and negative supply potentials are shown applied to operational amplifier comparator 402 and not to operational amplifier comparators, since it is assumed in this example that all three comparators are part of a single integrated-circuit chip which within itself provides interconnection of the positive and negative supply terminals of the three devices, so that connection of supply voltage to any one of them is sufficient for proper operation.

Figure 4:
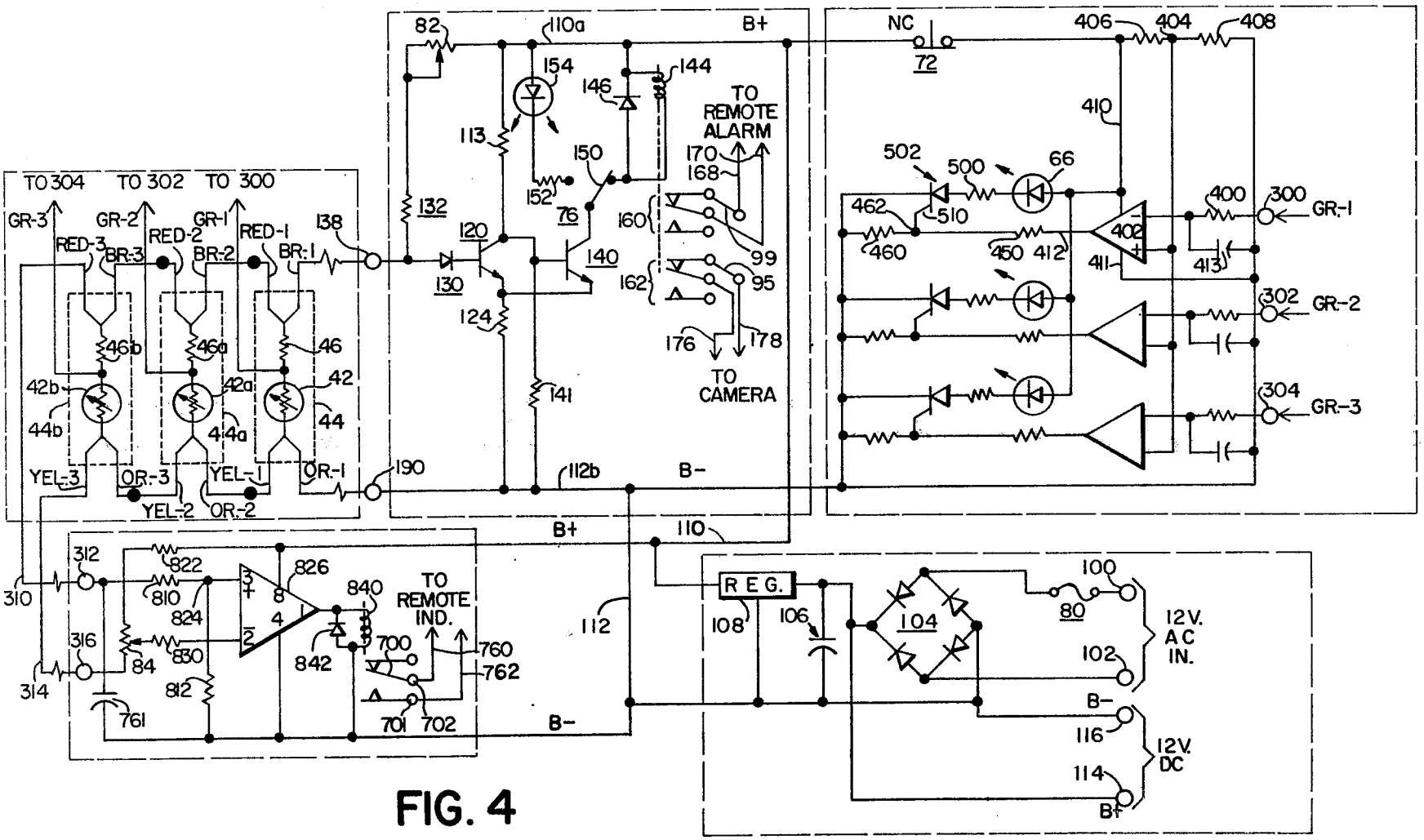
FIG. 4 is an electrical schematic diagram illustrating one preferred form of embodiment of the invention.

Considering now the details of the line-monitoring portion of the system shown in the lower left section of FIG. 4, the function of this circuit is to actuate relay switch arm 700 from the position shown into its opposite position in which it connects terminal 701 to terminal 702, and to maintain it in this actuated position so long as no break exists in the photocell positive supply line extending from terminal 138 to each of the photocell circuits in sequence and thence to terminal 312, so long as no break exists in the negative photocell supply line extending from terminal 190 to the lower ends of each of the photocells in sequence and thence to terminal 316, and so long as no short-circuit exists between the positive and negative photocell supply lines. The occurrence of any of the latter breaks or short-circuits will cause arm 700 to return to the open position shown, a condition which will be indicated to a remote indicator by way of the leads 760 and 762 connected to terminals 702 and 701 respectively, so that knowledge of the break or short-circuit will be conveyed immediately to maintenance personnel at the remote control station.

This line-monitoring function is provided by the following specific circuitry, in this example of the invention. Terminal 312 is connected to the system negative supply line by way of the pair of series resistors 810 and 812, while terminal 316 is connected through variably-tapped resistor 84 and fixed resistor 822 to the system positive supply line. The voltage-dividing tap poing 824 between resistor 810 and 812 is connected to the positive input of operational amplifier comparator 826, while the variable voltage-dividing tap point of resistor 84 is connected through a series resistor 830 to the negative input terminal of the latter comparator. The output terminal of comparator 826 is connected through the parallel combination of relay coil 840 and transient-damping diode 842 to the system negative supply line, relay coil 840 being arranged to move relay contact arm 700 to its alternate position in response to current through the coil. More particularly, when relay coil 840 is conducting, it maintains the movable arm 700 of the relay contacts associated therewith in a position opposite to that shown in the drawing, thereby short-circuiting contacts 701 and 702 to each other and maintaining a remote indicator, such as lamp 65, illuminated to show that the line-monitoring circuit is indicating a proper condition of the monitored lines. A bypass filtering capacitor 761 is connected between line-monitoring input terminal 312 and the system negative supply line to minimize the effects of interference and electrical noise. Variably-tapped resistor 84 provides the line monitoring adjustment shown at 84 on the alarm control box 60 in FIG. 1, and is set to provide the above-described operation of the comparator device 826.

Comparator device 826 is also provided with positive and negative operating supply voltages at its supply terminals 8 and 4 respectively, and will produce output current through coil 840 only when the latter supply voltages are present at the comparator, and its input terminal 3 is positive with respect to its other input terminal 2. As an example only, when the monitored lines are in proper condition, the voltage at input terminal 3 of device 826 may be about 1 volt, and the voltage at input terminal 2 thereof may be about 0.1 volt, causing current through relay 840 and causing relay switch arm 700 to be actuated to its alternate position for which the remote line-monitoring lamp 65 is illuminated. However, if a break should occur anywhere in the positive supply line supplying positive voltage to the three photocell branch circuits, anywhere between terminal 138 and terminal 312, or should a break occur in the negative supply line for the photocell circuit anywhere between terminal 190 and terminal 316, or should the circuitry at the alarm control box fail to supply the appropriate level of positive voltage to terminal 138, then the voltage at input terminal 3 of comparator 826 will drop to zero (system ground), thus becoming less positive than input terminal 2 of comparator 826, with the result that current through the relay coil 840 will be terminated, relay contacts switch arm 700 will return to the position shown in the drawing, and the remote line-monitoring lamp 65 will be extinguished, indicating a circuit fault.

If a break should occur in the negative supply line for the photocell branch circuit, anywhere between terminal 190 and terminal 316, the voltage at input terminal 2 of comparator 826 will tend to rise to the positive supply voltage, and hence to a value greater than the voltage at comparator input terminal 3, thereby also causing the current through relay coil 840 to terminate and the remote line-monitoring lamp to become extinguished.

Should a break occur simultaneously in both the positive and negative supply lines for the photocell branch circuits, comparator input terminal 3 will tend to assume the negative supply potential while input terminal 2 thereof will tend to assume positive supply potential, again causing the remote line monitoring lamp to become extinguished.

If a short-circuit should occur between the positive and negative supply lines for the photocell branch circuits, both of input terminals 312 and 316 will assume substantially zero potential (the negative system supply potential), whereby the potential at input terminal 3 of comparator 826 will become substantially zero while that at input terminal 2 thereof will be somewhat positive, again causing the termination of current through relay coil 840 and extinction of the line-monitoring light to indicate a faulty condition. Such a short-circuit will also produce an effect on the alarm circuit similar to that produced by removal of one of the packets of bills does, causing the remote alarm to be sounded and the camera to operate. However, the person monitoring the remote alarm will also be able to observe that the line-monitor lamp is out, thus realizing that the alarm is probably due to a break or short-circuit in the leads at the photocell circuits, and that steps to secure circuit repairs should be instituted.

Further, should the power supply for operating supply terminals 8 and 4 of comparator 826 be turned off, or interrupted due to a circuit malfunction, comparator 826 will not operate to produce current through the relay coil 840, and again the line-monitoring lamp will indicate a malfuction.

Accordingly, the line-monitoring relay and the line-monitoring lamp will remain actuated only when the photocell branch circuits are being properly supplied with their positive and negative supply voltages, and when the line-monitoring operational amplifier comparator itself is receiving proper supply voltages.

Returning now to consideration particularly of FIG. 1, in the embodiment shown each set of five wires in each of the five-wire flexible cables 52, 52*a* and 52*b* extends to a position adjacent to the corresponding teller location, where each wire is secured and connected to a different one of the corresponding five terminals on respective terminal strips 900, 902 and 904; each such strip may, for example, be mounted under the counter at the corresponding teller location. As will be seen from FIG. 1, the wire cable 910 extending from the alarm control box to the various teller locations consists of wires BR-1 and OR-1 providing the positive and negative voltages to one end of the supply lines for the photocell branch circuits, wires YEL-3 and RED-3 extend from the opposite ends of these supply lines back to the line-monitoring circuit at the alarm control box, and wires GR-1, GR-2 and GR-3 indicating which photocell is illuminated, each of the latter wires extending from a different one of the photocells.

Thus in providing the desired overall operation, the cable from the alarm control box to the teller positions contains only four wires plus one additional wire for each teller location; only a single five-wire cable is used between each photocell base plate and its associated terminal strip; only two wires extend between the different successive terminal strips at the several teller locations; and only a single common current-sensing resistance is used, at the control box. The system is readily extended to include other teller locations by corresponding wiring thereof; in this example, the system may be expanded to include up to eight teller locations, although this is not a limitation on the use of the invention.

In one representative embodiment of the invention of the form shown in FIG. 4, specific types and values of elements employed therein may be as follows:

Resistors, 46, 46*a*, 46*b*—each 20,000 ohms.
Photocells, 42, 42*a*, 42*b*—each type Clairex CL 703-L
Resistor 132—130,000 ohms.
Resistor 82—0 to 50,000 ohms.
Diode 130—type IN4003
Resistor 124—20 ohms.
Resistor 141—560,000 ohms.
Resistor 122—2,200 ohms.
Resistor 152—330,000 ohms.
Diodes 146 and 842—each type 1N270
Transistors 120 and 140—each type 6515
Resistor 810—255,000 ohms.
Resistor 830—255,000 ohms.
Resistor 822—68,000 ohms.
Resistor 812—255,000 ohms.
Operational amplifier 826—type LM358
Capacitor 761—0.1 microfarad
Resistor 400—470,000 ohms.
Capacitor 413—0.01 microfarad
Operational amplifier 402—type LM324.
Resistor 450—12,000 ohms.
Resistor 460—1,500 ohms.
Resistor 406—820,000 ohms.
Resistor 408—13,000 ohms.
Resistor 500—1,000 ohms.
Silicon controlled rectifier 502—type MCR102
Resistor 113—2,200 ohms.

While the invention has been described with particular reference to specific embodiments thereof in the interest of complete definiteness, it will be understood that it may be embodied in a variety of forms diverse from those specifically shown and described, without departing from the spirit and scope of the invention as defined by the appended claims.

What is claimed is:

1. Apparatus for providing first remote indications of the removal of any of a plurality of protected objects from any of a plurality of corresponding monitored locations, and for providing second remote indications of the monitored location at which such removal has occurred, comprising:

a plurality of object-sensing means, one at each of a plurality of monitored locations and each disposed so that its conductance changes from a normal reference level to a different level in response to removal of the associated protected object from its monitored location;

paralleling connection means connecting said plurality of object-sensing means in a parallel circuit with each other;

a source of supply voltage connected across said parallel circuit to apply a voltage across each of said object-sensing means;

common current-sensing means for said object-sensing means, and means connecting said common current-sensing means in series with said parallel circuit, across said source of supply voltage, to produce first electrical signals at said common current-sensing means which are indicative of changes in current through said common current-sensing means due to said changes in conductance of any of said object-sensing means;

a plurality of location-identifying means, comprising a plurality of conductance-sensing means each associated with and positioned adjacent a different corresponding one of said object-sensing means for producing a set of separate corresponding second signals indicative of changes in the conductance of the corresponding adjacent object-sensing means;

separate conductor means connected to each of said location-identifying means; and indicator means remote from said object-sensing means but electrically connected thereto, and responsive to said first signals at said common current-sensing means to produce first indications indicative of changes in conductance of any of said object-sensing means to said different level and to terminate said first indications when the conductances of all of said object-sensing means return to said reference levels, and responsive to said second signals to produce second indications indicative of which of said object-sensing means has changed its conductance to said different level, said indicator means comprising latching circuit means for causing said second indications to persist despite replacement of the previously removed protected object, and reset means manually operable after said replacement to terminate said second remote indications and to return said apparatus to its original state.

2. The apparatus of claim 1, wherein each of said object-sensing means comprises photo-sensor means positioned so that its illumination changes in response to said removal of the associated protected object.

3. The apparatus of claim 2, wherein each said photosensor means is positioned to be shadowed by its corresponding protected object when said last-named object is in its monitored location.

4. The apparatus of claim 1, wherein said common current-sensing means comprises a resistive means.

5. The apparatus of claim 4, wherein said common current-sensing means is located at a remote location with respect to said object-sensing means.

6. The apparatus of claim 1, wherein each of said conductance-sensing means comprises a separate resistive means in series with the current path through its associated object-sensing means.

7. The apparatus of claim 1, wherein said indicator means comprises two indicator stations remote from each other, at one of which said first indications are produced and at the other of which said second indications are produced.

8. The apparatus of claim 1, comprising test means including manually-actuable switch means operative, when actuated, to prevent the occurrence of said first remote indications and to substitute therefor test indications of a different type.

9. The apparatus of claim 1, comprising line-monitoring means for producing indications of a break in said parallel-connection means.

10. In a system for producing first remote indications of the removal of a packet of real or simulated currency bills from its monitored location at any of a plurality of teller locations in a bank and for producing second remote indications of that teller location at which such removal has occurred, comprising a plurality of photosensor means each associated with a different one of said teller locations and positioned so that each exhibits a lowered conductance when said packet is in its monitored location than when it is removed therefrom, a supply source for applying a voltage across each of said photo-sensor means, remote indicator means, and electrical circuit means interconnecting said photo-sensor means and connecting said photo-sensor means to said indicator means to produce said indications, the improvement wherein:

said electrical circuit means comprises a pair of conductors respectively connected to opposite terminals of said supply source, means connecting said plurality of photo-sensor means each in its own branch circuit and in parallel circuit with each other between said conductors so as to be supplied in parallel with voltage from said source, and common current-sensing means, remote from said photo-sensor means, in series with said parallel circuit and responsive to increases in current through any of said photo-sensor means to produce said first indications of removal of a packet from any of said monitored locations.

11. The system of claim 10, wherein said electrical circuit means further comprises a plurality of individual current-sensing means each connected in a different one of said branch circuits, and a corresponding plurality of conductors each extending from a different one of said branch circuits to a remote location and responsive to increases in current in its associated branch circuit to produce said second remote indications.

12. A system for producing alarm indications when a packet of currency is absent from any one of a plurality n of cash-handling stations on protected premises, for producing station-identifying indications representative of those of said n stations at which a packet of currency is absent, and for producing fault indications indicative of the occurrence of a fault in wiring in said system, comprising:

n base plates, one at each of said stations, and each adapted to receive one of said packets thereon;

n photocells, each associated with a different one of said base plates so as to be shielded from illumination when one of said packets is positioned thereon, and to be illuminated and to increase its conductance when no packet is positioned thereon;

n resistors, one at each of said stations, each connected in series with a different one of said n photocells to form n photocell circuits;

a positive photocell supply line and a negative photocell supply line, connecting said n photocell circuits in series-parallel circuit, with said photocell circuits in parallel with each other between said lines at different points on said lines;

an alarm control box on said premises;

a source of positive supply voltage and a source of negative supply voltage at said control box;

means connecting said common resistive means between said positive supply source and one end of said positive photocell supply line, and means connecting said negative supply source to one end of said negative photocell supply line;

common current-sensing resistive means connected between said positive supply source and said negative supply source and in series with said series-parallel circuit, for producing a first signal representative of the current flowing through said photocells;

alarm means connected to said control box but remote from said control box and from said cash-handling stations, and means responsive to said first signal for actuating said alarm means when at least one of said packets is absent from the position in which it shields its associated photocell from illumination;

n photocell-identifying leads each extending to said control box from a different one of said n resistors at the end thereof connected to its corresponding photocell;

n teller-identifying lamp means at said control box, each identifiable as being associated with a different corresponding one of said teller stations;

n lamp-control circuits at said control box and each connected to a different corresponding one of said photocell identifying leads for turning on any of said lamp means in response to an increase in current of the corresponding photocell due to illumination thereof;

said lamp-control circuits comprising latch means for maintaining any of said lamp means illuminated, once turned on, despite subsequent termination of illumination of the corresponding photocell, until said lamp-control circuits are manually reset;

manually-operable reset means at said control box, operable to defeat said latch means and to extinguish all of said lamp means, and to reset said lamp-control circuits;

manually-operable test switch means and test indicator means at said control box, said test switch means being operable to render said alarm means inoperable and to substitute said test indicator means for said alarm means while said test switch means is being operated, whereby the operability of the portion of said system on said premises may be tested by exposing at least one of said photocells to illumination while said test switch means is being operated; and line-monitoring means for continuously monitoring the continuity of said positive and negative photocell supply lines, comprising: an operational-amplifier voltage comparator having a first input terminal, a second input terminal, and an output terminal from which it produces current only when said first terminal is more positive than said second terminal; first voltage-divider means connected between the opposite end of said positive photocell supply line and said negative supply source; first means connected a tap point on said first voltage divider means to said first input terminal; second voltage divider means connected between the opposite end of said negative photocell supply line and said positive supply source; second means connecting a tap point on said second voltage divider to said second input terminal; and line-condition indicating means responsive to current from said third terminal to produce indications of the continuity of said positive and negative photocell supply lines.

13. A line-monitoring circuit for producing a signal indicative of a break in either or both of a first conductive line and a second conductive line, said first conductive line being connected at one end thereof to a first source of a direct, relatively more positive, electrical potential and said second conductive line being connected at one end thereof to a second source of a direct, relatively more negative, electrical potential, comprising:

voltage comparator means having a first input terminal and a second input terminal, and having an output terminal from which it produces current only when said first input terminal is more positive than said second input terminal;

first voltage-divider means connected between the opposite end of said first conductive line and said source of more negative potential;

first means connecting a tap point on said first voltage divider means to said first input terminal;

second voltage divider means connected between the opposite end of said second conductive line and said source of more positive potential; and second means connecting a tap point on said second voltage divider means to said second input terminal;

whereby said voltage comparator means produces an output current from said output terminal when said first and second conductive lines are intact but produces a decreased output current when a break occurs in either or both of said first and second conductive lines.

14. The circuit of claim 13, wherein said decreased current is substantially zero.

15. The circuit of claim 13, wherein said voltage comparator means is provided with necessary operating supply voltages by connections to said first and second sources, whereby said output current is prevented from occurring if a break occurs in said connections.

16. The circuit of claim 13, wherein said voltage comparator means comprises an operational amplifier, and said first and second input terminals constitute high-impedance input terminals thereof, thereby to minimize electrical loading of said first and second conductive lines by said comparator means.

17. The system of claim 10, wherein said parallel circuit comprises a pair of conductive lines running between said branch circuit connecting said branch circuits in parallel arrangement and said opposite terminals of said supply source are connected to one end of said conductive lines, and comprising line-monitoring means connected to the other end of said pair of conductive lines.

18. The system of claim 17, wherein said line-monitoring means comprises: voltage comparator means having a first input terminal and a second input terminal, and having an output terminal from which it produces current only when said first terminal is more positive than said second input terminal; first voltage-divider means connected between said other end of one of said conductive lines and one terminal of said supply source; first means connecting a tap point on said first voltage divider means to said first comparator input terminal; second voltage divider means connected between said other end of one of said conductive lines and the other terminal of said supply source; and second means connecting a tap point on said voltage divider means to said second input terminal.

19. In a system for producing remote indications of the removal of any of a plurality of protected objects from any of a plurality of corresponding different monitored locations:

a plurality of two-terminal electrical object-sensing units, one at each of a plurality of monitored locations and each disposed so that its conductance between its two terminals changes from a normal reference value when its associated object is present to an abnormal value when its associated object is removed;

first interconnecting conductor means extending between said monitored locations and connecting one set of corresponding terminals of said object-sensing units directly together in tandem;

second interconnecting conductor means extending between said monitored locations and connecting the other set of corresponding terminals of said object-sensing units directly together in tandem;

means for supplying an input voltage between the corresponding ends of said first and second interconnecting conductor means;

means for sensing the output voltage between the other ends of said first and second interconnecting conductor means to produce indications of defects in said first and second interconnecting conductor means; and indicator means remote from said object sensing units but electrically connected thereto, and responsive to said changes in conductance to produce said remote indications.

20. The system of claim 19, wherein each of said object-sensing units comprises a photosensor device and current-sensing means connected adjacent said photosensor device for sensing the current through said photosensor device.

21. The system of claim 20, wherein said current-sensing means comprises a resistive element in series with said photosensor device, wherein said one set of terminals comprises the terminals of said resistive elements more remote from said photosensor devices, and wherein said other set of terminals comprises the terminals of said photosensor devices more remote from said resistive elements.

22. The system of claim 19, wherein said means for supplying an input voltage comprises common current-sensing means, a fixed voltage source, and means connecting one terminal of said voltage source to one of said corresponding ends of said first and second interconnecting conductor means and connecting said common current-sensing means between the other terminal of said fixed-voltage source and the other of said corresponding ends of said first and second interconnecting conductor means.

23. Apparatus for providing first remote alarm indications of the removal of any of a plurality of protected objects from any of a plurality of corresponding monitored locations, and for providing second remote indications of the monitored location at which such removal has occurred, comprising:

a plurality of object-sensing units, one at each of a plurality of monitored locations, and each comprising a photosensor device adapted to be shaded from illumination when a protected object is removed from the corresponding monitored location and to be illuminated when said corresponding object is removed and a resistive element connected in series therewith for sensing changes in the current through said photosensor device, each of said object-sensing units having a first terminal and a second terminal both secured thereto and between which its associated photosensor device and resistive element are connected in series;

first paralleling conductor means and second paralleling conductor connecting said object-sensing units in parallel with each other, said first paralleling conductor means extending between said object-sensing units and connecting said first terminals thereof together in tandem, said second paralleling conductor means extending between said object-sensing units and connecting said second terminals thereof together in tandem;

a voltage source, common resistive current-sensing means, means connecting one terminal of said common resistive current-sensing means to one end of said first paralleling conductor means, and means connecting said voltage source between the other terminal of said common resistive current-sensing means and one end of said second paralleling conductor means;

line-monitoring circuit means connected between the other ends of said first and second paralleling conductor means for producing indications of changes in the voltage therebetween due to faults in either of said first and second paralleling conductor means;

first indicator means connected to said common resistive current-sensing means for producing alarm indications only when the current through said common resistive current-sensing means is above a predetermined value in response to conduction through any of said photosensors;

second indicator means and means connecting said resistive means to said indicator means, for initiating indications of which of said photosensors have been rendered conductive by removal of the corresponding object from its monitored location; latching means for maintaining said last-named indications after said corresponding object has been replaced; and manual reset means for thereafter terminating said last-named indications.

* * * * *

UNITED STATES PATENT AND TRADEMARK OFFICE

CERTIFICATE OF CORRECTION

PATENT NO. : 4,268,823

DATED : May 19, 1981

INVENTOR(S) : Robert J. Rauchut and Louis J. Caparoni

It is certified that error appears in the above-identified patent and that said Letters Patent are hereby corrected as shown below:

Column 7, line 50, "44" should be --64--.

Column 7, line 22, "an" should be --as--.

Column 9, line 8, "voltge" should be --voltage--.

Column 9, line 28, after "common-emitter", "circuit" was omitted.

Column 11, line 38, "flase" should be --false--.

Column 12, line 42, "poing" should be --point--.

Column 13, line 40, "poing" should be --point--.

Signed and Sealed this

*Seventeenth* Day of *November 1981*

[SEAL]

*Attest:*

GERALD J. MOSSINGHOFF

*Attesting Officer*

*Commissioner of Patents and Trademarks*